United States Patent [19]

Leonhardt

[11] Patent Number: 4,741,535

[45] Date of Patent: May 3, 1988

[54] GOLF PUTTER

[76] Inventor: Robert L. Leonhardt, 14201 Poplar La., Jeffersontown, Ky. 40299

[21] Appl. No.: 833,894

[22] Filed: Feb. 26, 1986

[51] Int. Cl.[4] ..... A63B 53/04

[52] U.S. Cl. ..... 273/164; 273/167 A; 273/169

[58] Field of Search ..... 273/164, 163 R, 169, 273/171, 183 D, 172, 167 F; D21/217, 218, 219

[56] References Cited

U.S. PATENT DOCUMENTS

| | | | |
|---|---|---|---|
| 27,732 | 10/1897 | Adams | D21/217 |
| 3,632,112 | 1/1972 | Jacobs | 273/164 X |
| 3,966,210 | 6/1976 | Rozmus | 273/169 |
| 4,034,989 | 11/1975 | Stewart | 273/164 |

*Primary Examiner*—George J. Marlo
*Attorney, Agent, or Firm*—Scott R. Cox

[57] ABSTRACT

A golf putter for use on a regulation golf course having weighted toe and heel portions and alignment shafts projecting rearward from the toe and heel of the putter. The alignment shafts may be about 1 to about 6 inches in length and about ⅓ to about 1 inch in width. The alignment shafts are perpendicular to the ball striking surface of the club head and are parallel to each other. The bottom surface of each of the alignment shaft slope slightly upward in a arc shaped line to allow striking of the golf ball more effectively. The distance between the center of the two shafts is approximately equal to the diameter of a golf hole. The putter also has a center alignment line located at the approximate center of the weight distribution of the head of the putter. This line, along with the two alignment shafts, assists the golfer in aligning his or her putt and reduces the tendency of the putter to rotate upon striking a ball off center.

1 Claim, 1 Drawing Sheet

GOLF PUTTER

BACKGROUND OF INVENTION

1. Field of Invention

This invention relates to golf putters and in particular to putters with alignment means for more accurate putting.

2. Prior Art

Golf putters represent a field of art which has received many innovations, some of which are scientifically well-founded, others of which may be considered merely psychological. However, whether the results are psychological or based on scientific reasoning, the value of the putter is in the results. Regardless, innovations which are scientifically sound are preferred since they are more widely accepted by a large range of golfers.

Through the years there has been much effort expended in improving golf clubs, particularly putters, and with much concentration on the development of means to enable a golfer to properly strike a golf ball on a true line toward the hole. In particular, it has been common to provide a method to align the head of the putter for more accurate putting. See, for example, U.S. Pat. Nos. 3,917,277, 3,866,922, 3,955,819, 3,921,984, 4,209,172, 4,519,612, and 3,880,430.

In addition, numerous efforts have been made to alter the weight distribution of a putter in an effort to reduce the tendency of a putter to rotate when a golf ball is struck off center. See, for example, U.S. Pat. Nos. 4,265,451, 3,843,122, 4,253,667, 4,369,974, and 1,537,320.

In addition, in the never-ending search to improve putting, numerous practice devices not usable on a golf course have been invented, including U.S. Pat. Nos. 4,153,235, 4,010,958, 3,893,678, 3,893,673, and 3,384,376.

However, none of these putters have combined the advantages of balanced weight distribution, an alignment line on the top of the putter and a set of rearward facing alignment shafts which are the same distance apart as is the diameter of a golf hole. U.S. Pat. No. 3,384,376 discloses a practice golf putter with a shaft running through the face of the putter and detachable guides directing both in front of and behind the face of the putter. Such a putter would not be a legal putter under the United States Golf Association Rules since it provides alignment means in front of the club face. In addition it does not provide the balanced weight distribution found to be most conducive for accurate putting.

Accordingly, it is an object in the invention to provide a golf putter usable on a regulation golf course having means for aligning a putting stroke.

A further object of the invention is to provide a golf putter for use on a regulation golf course with a balanced weight distribution.

A still further object of the invention is to provide a novel means for aligning the putter by the use of rearward directing shafts running from the rear of the toe and the heel of the putter backwards which are approximately the same distance apart as is the diameter of a golf hole.

Other objects and features of the present invention will become apparent from a consideration of the following description. The description along with the accompanying drawings provide a selected example of construction to illustrate the invention.

SUMMARY OF INVENTION

In accordance with the present invention there is provided a unique golf putter with a head connected thereto, the putter head comprising:

(a) a heel portion;
(b) a center portion;
(c) a toe portion;
(d) a smooth bottom surface;
(e) a ball striking surface for striking a golf ball; and
(f) alignment shafts directed rearward from the club head.

BRIEF DESCRIPTION OF THE DRAWINGS

The invention will now be described with reference to the accompanying drawings in which.

DETAILED DESCRIPTION OF THE PREFERRED EMBODIMENT

Figure 1:
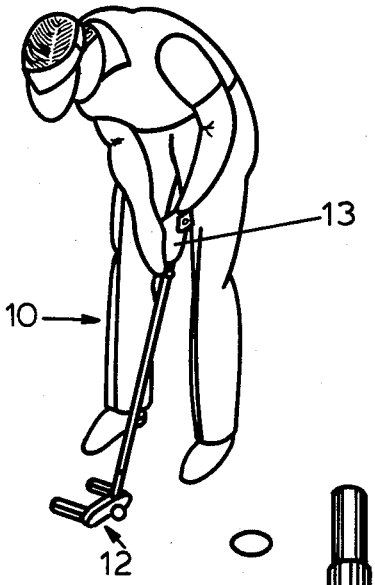
FIG. 1 is a frontal view of the entire golf putter being held by a golfer in a position to strike a golf ball.
Figure 2:
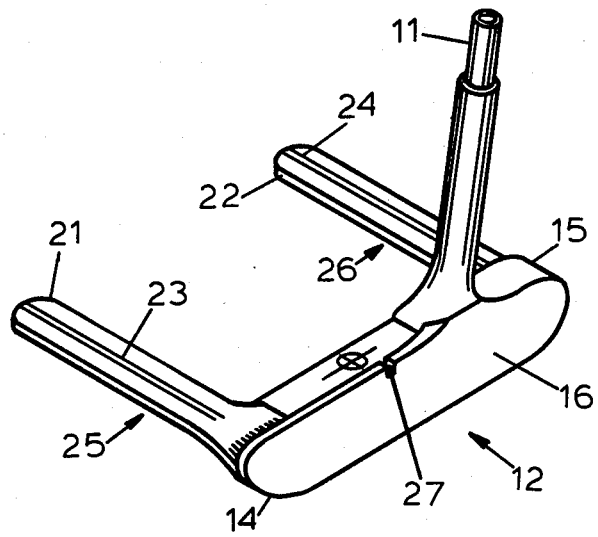
FIG. 2 is a front side elevated view, showing the head of the putter and a portion of the connected golf club shaft.
Figure 4:
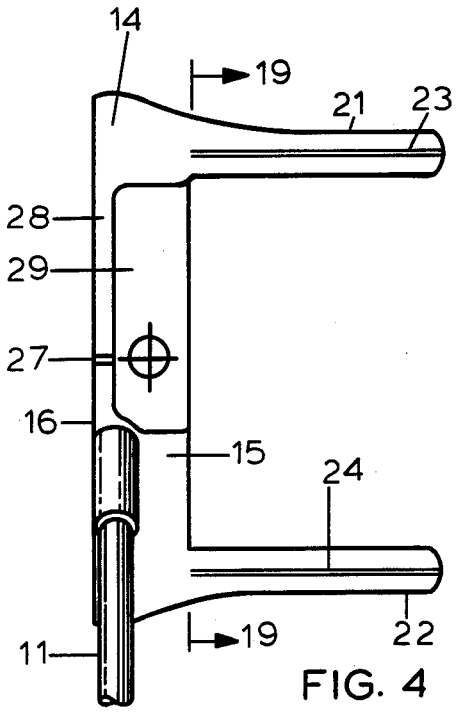
FIG. 4 is a top view of the head of the putter.
Figure 5:
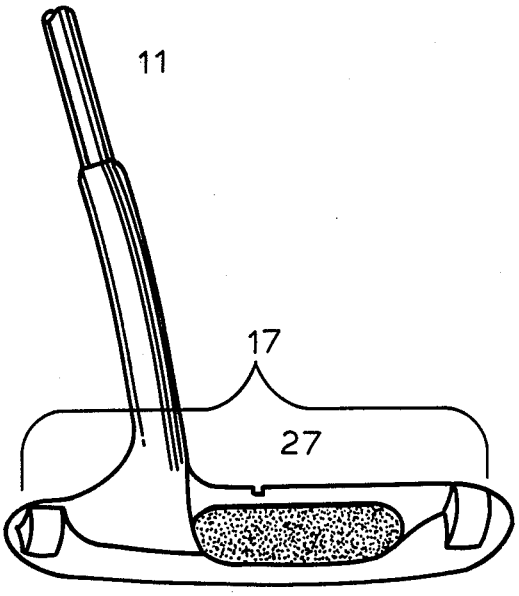
FIG. 5 is a rear view of the head of the putter.

Although the invention is applicable to a wide variety of applications, it is shown in the drawings for purposes of illustration as embodied in a golf putter (10) including a shaft (11) connected to a putter head (12) at its lower end. In FIG. 1, a golf putter is shown grasped in the hands of a golfer. In FIGS. 2, 4 and 5, the putter head (12) of the putter (10) is illustrated having a toe portion (14), a heel portion (15), a center portion (20), a ball striking surface (16), a top portion (17), bottom surface (18) and a rear portion (19) of the putter. It is understood that the golf putter as illustrated is for a right-handed golfer. The putter can also be altered to be used by a left-handed golfer. By centering the shaft and equalizing the weight distribution between the heel and the toe portions, the putter is also adaptable for use as a croquet or mallet-type putter.

The putter shaft (11) extends at a slight incline from its point of connection with the putter head toward the grip (13) of the putter. The angle of incline can be adjusted to fit the personal preference of the golfer. The heel (15) of the putter is that portion of the club head closest to the golfer, and the toe (14) of the putter is that portion which is the furthest from the golfer.

The putter shaft (11) is secured to the putter head (12) about one-sixth to one-third of the distance between the heel (15) and the toe (14) of the putter head. See FIG. 5. The putter shaft (11) may be bent prior to its connection with the putter head so that that portion of the shaft above the bend points slightly ahead of the ball striking surface (16) of the putter. This is accomplished by bending the bottom of the shaft of the putter slightly inward just above where it meets the putter head. In this embodiment the putter shaft will point to approximately the back half of a golf ball when it is struck.

The bottom surface (18) of the putter is curved in a compound curvature best illustrated by referring to FIG. 5 wherein the bottom surface, while generally flat, tapers upward slightly at each end of the putter. The purpose of the tapering at the ends is to minimize the possibility that the putter head will strike an uneven portion of the green during a putting stroke and result in an erratic stroke. The degree of tapering can be adjusted to meet the desires of the individual golfer. The bottom surface may be coated with some low friction material such as Teflon. This low friction coating will reduce any frictional drag that might occur between the bottom surface of the putter and the putting surface during a putting stroke.

The ball striking surface (16) of the putter as shown in FIG. 2 is a smooth, flat, surface perpendicular to the bottom surface (18) of the putter. It extends the length of putter head.

Figure 3:
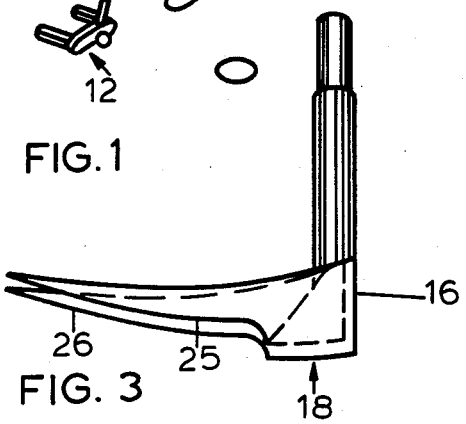
FIG. 3 is a side view of the head of the putter as viewed from the toe of the head of the putter.

Attached to the heel portion (15) and the toe portion (14) of the putter head are two alignment shafts (21, 22) extending rearward from the rear portion of the putter head. Alignment marks or lines (23, 24) run through the center of the top surface of each of these alignment shafts. These alignment marks are perpendicular to the striking surface (16) of the putter head. These two alignment marks are, of course, parallel and should be spaced so that the distance between them is approximately that of the diameter of a golf hole. Each of the alignment shafts may be about 1 to about 6 inches long. In a preferred embodiment, these alignment shafts are about 2 to about 4 inches long. Each of the alignment shafts can be of varying widths and heights depending on the desire of the golfer. In a preferred embodiment these shafts are about $\frac{1}{8}$ to about 1 inch in width. As shown in FIG. 3, the bottom surface (25, 26) of each of these alignment shafts slopes slightly upward in an arc-shaped line. Therefore the height of the alignment shaft will vary from its tip to where it meets the heel or toe of the putter head. The amount of the upward arc of these alignment shafts is dependent upon the length of the alignment shaft and the size of arc of the swing of the golfer. The alignment shafts are inclined upward so that after striking of the golf ball, the shafts will not hit the surface of the green and therefore reduce the effectiveness of the putt. The alignment shafts are joined to the putter by any conventional method such as welding. Alternatively, the shafts and the putter can be initially cast or formed as a single unit. The overall shape of the alignment shaft is not crucial to the invention as long as they project rearward from the putter head. It is crucial to this putter that the alignment shafts only extend rearward from the head of the club and do not extend forward since such forward extension would be a violation of the United States Golf Association Rules.

Referring to FIG. 4, the heel portion (15) of the putter, which includes an alignment shaft (22) and that portion of the putter head from the tip of the heel of the putter to where the shaft of the putter (11) joins the putter head, is weighted from approximately 30% to approximately 50% of the total weight of the head of the putter. This increase in the weight of the heel is accomplished by increasing the thickness of the heel portion (15) of the putter as compared to the center portion (20) of the putter. The heel of the putter comprises from about 5 to about 30% of the width of the putter head. The width is the distance from the tip of the toe to the tip of the heel of the putter head. The toe (14) of the putter head which comprises about 5 to about 30% of the width of the putter head and includes the other alignment shaft (21) (see FIGS. 4 and 5) is also weighted by increasing its thickness similar to that in the heel portion (15) of the putter. The weighting of the toe (14) of the putter comprises about 20–40% of the total weight of the putter head. As shown in FIGS. 4 and 5, the thickness of the remaining portion of the putter head, the center portion (20), between the toe and heel is reduced. This center portion (20) of the putter head is divided into a front portion (28) and a rear portion (29). The front portion (28) is equal in height to the ball striking surface (16) of the putter head with a depth of about 1/16 to about $\frac{3}{4}$ of an inch. The rear portion (29) of the center portion of the putter head is about 1/16 to about $\frac{3}{4}$ of an inch in height and comprises the remaining portion of the depth of the center portion of the putter head.

On the top surface (17) of the putter head at a point of equal weight distribution between the toe and the heel of the putter head is a third alignment mark or indentation (27) in the putter perpendicular to the striking surface (16) of the putter. See FIGS. 2 and 4. This third alignment mark (27) functions as a reference mark for the golfer and indicates where the center of the ball should be struck. In a preferred embodiment, the third alignment mark runs from the ball stiking surface to the back of the putter head.

The center of gravity of the putter head lies centrally located between the toe (14) and the heel (15) of the putter. The weight distribution between the toe and the heel should result in an equal weight distribution on each side of the third alignment mark (27). In a preferred embodiment, the distance between the toe and the heel portions of the putter head should be reasonable, from about 2 to about 6 inches. By increasing this distance, the stability of the putter is increased. In this way, the moment of inertia of the putter head is increased substantially so that if the putter head strikes the golf ball at a point to one side or the other of the center of gravity, the added mass of the putter head spaced on either side of the center of gravity will reduce the tendency of the club to twist about a vertical axis extending through the center of gravity of the putter head.

In the operation of the putter, the golfer assumes his normal position above the golf ball with the putter in hand. The ball is lined up so that its center is aligned as close as possible with the third alignment mark on the top surface of the putter at the center of the putter head. The alignment shafts with marked alignment lines directed rearward from the head of the putter provide a further alignment means for the golfer to visualize the putt prior to striking the ball. By visualizing not only the line the golfer believes the ball will take when struck but also the size of the hole, the golfer can more accurately strike the ball. The weight of the putter head is directed toward each end of the putter head and acts to limit rotation of the putter head if the ball is hit off center. The combination of the rearward directing alignment shafts and the weight distribution allows the golfer to control his or her putt in a new and unique manner.

I claim:

1. A golf putter with a head connected thereto, the putter head comprising:

(a) a heel portion comprising 15–25 percent of the width of the putter head and 30–50 percent of the weight of the putter head;

(b) a center portion comprising 10–45 percent of the weight of the putter head and 40–75 percent of the width of the putter head and is divided into a front portion equal in height to the club head with a depth of 1/16 of an inch to $\frac{3}{4}$ of an inch and a rear portion whose height is 1/16 of an inch to $\frac{3}{4}$ of an inch and whose depth is $\frac{1}{8}$ of an inch to 2 inches;

(c) a toe portion comprising 5–25 percent of the width of the putter head and 25–40 percent of the weight of the putter head;

(d) a smooth bottom surface;

(e) a ball striking surface for striking a golf ball;

(f) a first and a second alignment shaft connected to the toe and the heel portions, respectively, of the putter head, the bottom surface of the alignment shafts being above the bottom surface of the putter head, each shaft being directed rearward from the toe and the heel portion of the putter head, each shaft being from 1 to 6 inches in length and $\frac{1}{3}$ of an inch in width, each shaft having an arcuate top and bottom surface arching upward along its length, each shaft having a centered marked line on the top surface perpendicular to the ball striking surface and said shafts being spaced apart approximately the same distance as the diameter of a golf hole; and (g) a third alignment mark on the top surface of the putter head extending at a right angle to the planar ball striking surface and located at approximately the center of the weight distribution of the putter head.

* * * * *